US008887817B2

(12) United States Patent
Le Briere et al.

(10) Patent No.: US 8,887,817 B2
(45) Date of Patent: Nov. 18, 2014

(54) INTERMEDIATE DISCONNECTION TOOL TO BE PLACED IN A SHUTTLE LOWERED INTO A WELL FOR EXPLOITING A FLUID, AND RELATED SHUTTLE AND METHOD

(75) Inventors: Bruno Le Briere, Paris (FR); Clement Laplane, Vincennes (FR); Abdelkader Didi, Le Pontet (FR); Vincent Chatelet, Le Blanc-Mesnil (FR)

(73) Assignee: Geoservices Equipements, Paris Nord II (FR)

( * ) Notice: Subject to any disclaimer, the term of this patent is extended or adjusted under 35 U.S.C. 154(b) by 442 days.

(21) Appl. No.: 13/377,568

(22) PCT Filed: Jun. 16, 2010

(86) PCT No.: PCT/FR2010/051195
§ 371 (c)(1), (2), (4) Date: Apr. 5, 2012

(87) PCT Pub. No.: WO2010/146305
PCT Pub. Date: Dec. 23, 2010

(65) Prior Publication Data

US 2012/0186826 A1 Jul. 26, 2012

(30) Foreign Application Priority Data

Jun. 17, 2009 (FR) ..... 09 54075

(51) Int. Cl.
*E21B 23/00* (2006.01)
*E21B 17/06* (2006.01)

(52) U.S. Cl.
CPC ..... *E21B 17/06* (2013.01)
USPC ..... 166/377; 166/242.6; 166/242.1

(58) Field of Classification Search
CPC ..... E21B 17/06
USPC ..... 166/377, 242.6, 242.1, 65.1, 65.6
See application file for complete search history.

(56) References Cited

U.S. PATENT DOCUMENTS

| | | | | |
|---|---|---|---|---|
| 5,984,006 | A | 11/1999 | Read et al. | |
| 2006/0278388 | A1 * | 12/2006 | Zanca et al. | 166/242.6 |
| 2007/0023191 | A1 * | 2/2007 | Dreggevik | 166/377 |
| 2012/0132439 | A1 * | 5/2012 | Ratcliffe et al. | 166/377 |

FOREIGN PATENT DOCUMENTS

| | | |
|---|---|---|
| FR | 2 848 363 | 6/2004 |
| WO | 03/048501 | 6/2003 |
| WO | 2004/090280 | 10/2004 |
| WO | 2010/061231 | 6/2010 |

* cited by examiner

*Primary Examiner* — Yong-Suk (Philip) Ro
(74) *Attorney, Agent, or Firm* — Stephanie Chi

(57) ABSTRACT

This tool comprises an upper portion and a lower portion able to move relative to each other between a connected position and a completely disconnected position. The tool comprises an immobilization member that can be freed from the upper portion relative to the lower portion, a member for releasing the immobilization member, and a mechanism for moving the release member housed in the tool. The movement mechanism comprises an actuator and a receptor for receiving a control signal.

17 Claims, 9 Drawing Sheets

INTERMEDIATE DISCONNECTION TOOL TO BE PLACED IN A SHUTTLE LOWERED INTO A WELL FOR EXPLOITING A FLUID, AND RELATED SHUTTLE AND METHOD

BACKGROUND

The present invention relates to an intermediate disconnecting tool intended to be placed in a lower assembly lowered into a fluid exploitation well, of the type comprising:

- an upper portion, intended to be connected to a cable working line, and a lower portion, intended to be connected to a bottom tool, the upper portion and the lower portion being mounted so as to move relative to each other between a position connected on each other and a completely disconnected position, in which the upper portion can be raised to the surface independently of the lower portion, one of the upper portion and of the lower portion defining a head, the other of the upper portion and the lower portion defining a receiving cavity receiving the head sealably in the connected position;
- at least one immobilization member that can be freed from the upper portion relative to the lower portion in the connected position;
- a member for releasing the immobilization member, mounted able to move between an activation position for activating the immobilization member and a release position for releasing the immobilization member;
- a mechanism for moving the release member housed in the tool, the movement mechanism comprising an actuator including an energy source, and a receptor receiving a control signal capable of powering the actuator via the energy source when the control signal is received.

To perform operations and/or measurements in a fluid exploitation well, it is known to lower intervention and/or measuring tools by positioning them in a lower assembly placed at the lower end of a cable working line. The lower assembly is lowered into the well using the cable working line to the operating and/or measuring point.

The cable working line is for example a smooth cable (referred to as a "slickline"), a stranded cable of the electric line type, or a coiled hollow flexible tube of the "coiled tubing" type.

Lowering the tool using such a line is easier to do than with drill rods, in particular when the line is a slickline.

However, once introduced into the well, under certain circumstances, the lower assembly remains blocked at the bottom of the well. This blocking can come, for example, from poor alignment of the lower assembly, an overly small local incline of the well, or poor operation of an anchoring or sealing system of the lower assembly.

In that case, the surface operator tries, for example, to exert a significant tractive force on the lower assembly using the cable working line to try to unblock the lower assembly. However, this maneuver is risky, since it can lead to breaking the cable working line. Subsequent fishing for the lower assembly remaining at the bottom of the well is then very complicated and the cable working line must be replaced, which can be expensive.

In certain cases, the lower assembly is provided with a slide making it possible to perform jarring to try to unjam the lower assembly. However, the impacts caused by the jarring can damage certain tools, in particular certain measuring tools including sensors sensitive to impacts.

To offset all of these problems, intermediate disconnecting tools have been designed to perform a controlled disconnection of the lower assembly relative to the cable working line.

These tools make it possible to raise the cable working line independently of the lower assembly and subsequently lower a retrieval tool better suited to unjamming the part of the lower assembly remaining at the bottom.

To that end, known for example is a disconnecting tool that is activated mechanically by making an object fall sliding along the cable working line to a release member of the line situated at the upper end of the lower assembly. Such a device is not fully satisfactory, in particular in inclined wells.

Also known from U.S. Pat. No. 5,984,006 is an intermediate disconnecting tool comprising an explosive load that can be triggered by a control signal transmitted from the surface via the stranded electrical cable. The explosive load installed in a tool of the lower assembly provides the necessary energy to a piston actuator that moves in the tool to release the cable working line. Other systems without explosive loads exist, but with the necessary energy transported from the surface via the electrical cable.

Such a tool is not completely satisfactory. It is in fact necessary to convey sufficient electrical power to the lower assembly to actuate the system or cause the explosion of the load that will actuate the system, which is in particular not possible when a slickline is used. Moreover, the explosive load necessary to move the piston can damage the tool.

One aim of the invention is therefore to obtain a disconnecting tool for a lower assembly jammed in the bottom of a well that is simple to actuate from the surface without a risk of damaging the tool.

To that end, the invention relates to a disconnecting tool of the aforementioned type, characterized in that the movement mechanism comprises at least one member for elastic stressing of the release member towards its release position and at least one retaining member for keeping the release member in its activation position against the stressing member, the actuator being able to release the retaining member after receiving the control signal.

SUMMARY

The tool according to the invention can comprise one or several of the following features, considered alone or according to all technically possible combinations:

- the tool defines at least one pressure equalization orifice, advantageously at least two, in particular two or three, connecting the inner cavity and the outside of the tool, the tool comprising a pressure equalization member mounted able to move in the or each pressure equalization orifice between a configuration closing the pressure equalization orifice and a pressure equalization configuration through the pressure equalization orifice, the release member in its activation position keeping the or each pressure equalization member in its closing configuration, the release member in its release position allowing the movement of the or each pressure equalization member from its closing configuration towards its pressure equalization configuration; the pressure equalization member being movable independently of the release member, in particular when the release member occupies its release position;
- the pressure equalization member comprises a rod defining an inner channel, the inner channel being released in the pressure equalization configuration, the inner channel being closed in the closing configuration;
- the release member defines a housing for receiving the pressure equalization member emerging in a peripheral surface of the release member, the pressure equalization member being arranged in the receiving housing in the release position;

the actuator comprises an electric motor, advantageously with a power of less than 5 watts, the energy source comprising an electrical power battery of the electric motor;

the actuator comprises a rotary cam, the retaining member cooperating with the rotary cam so that the rotation of the rotary cam disengages the retaining member from the release member;

the retaining member comprises at least one pivoting hook having a free end engaged against the rotary cam;

the receptor receiving the control signal is capable of receiving an electric, electromagnetic, magnetic, mechanical or acoustic control signal emitted from the surface when the tool is arranged in the well; and the upper portion comprises a first electric section, the lower portion comprising a second electric section intended to be connected to an electrical line of the bottom tool, the tool comprising at least one intermediate electrical section connecting the first section to the second section, the intermediate electrical section being disconnectable when the tool goes from its connected position to its disconnected position.

The invention also relates to a lower assembly intended to be lowered in a fluid production well, characterized in that it comprises:

a connector connecting to a cable working line;

at least one bottom tool; and an intermediate disconnecting tool as defined above, and in that, at least in the disconnected position, the connector is connected to the upper portion, the bottom tool being connected to the lower portion.

The lower assembly according to the invention can comprise one or several of the following features considered alone or according to all technically possible combinations:

it comprises at least one measuring tool inserted between the upper portion and the connector, the lower assembly comprising at least one intervention and/or measuring tool arranged under the lower portion.

The invention also relates to a method for disconnecting a lower assembly as defined above, characterized in that it comprises the following steps:

receiving a control signal of the actuator from the surface via the receptor;

activating the actuator via the energy source housed in the tool;

disengaging the retaining member via the actuator away from the release member;

moving the release member between its activation position of the immobilization member and its release position of the immobilization member under the effect of the stress member and release of the immobilization member;

moving the upper portion via the cable working line, without moving the lower portion to go from the connected position to the completely disconnected position.

The method according to the invention can comprise one or several of the following features, considered alone or according to all technically possible combinations:

the tool defines at least one pressure equalization orifice connecting the inner cavity and the outside of the tool, the tool comprising a pressure equalization member mounted able to be moved in the pressure equalization orifice between a closing configuration closing the pressure equalization orifice and a pressure equalization configuration through the pressure equalization orifice, the method comprising the passage of the pressure equalization member from its closing configuration towards its pressure equalization configuration when the release member reaches its release position;

the pressure equalization member goes from its closing configuration to its pressure equalization configuration under the effect of the pressure from the outside fluid applied on the tool.

The invention will be better understood upon reading the following description, provided solely as an example and done in reference to the appended drawings, in which:

BRIEF DISCRIPTION OF THE DRAWINGS

DETAILED DISCRIPTION

Figure 1:
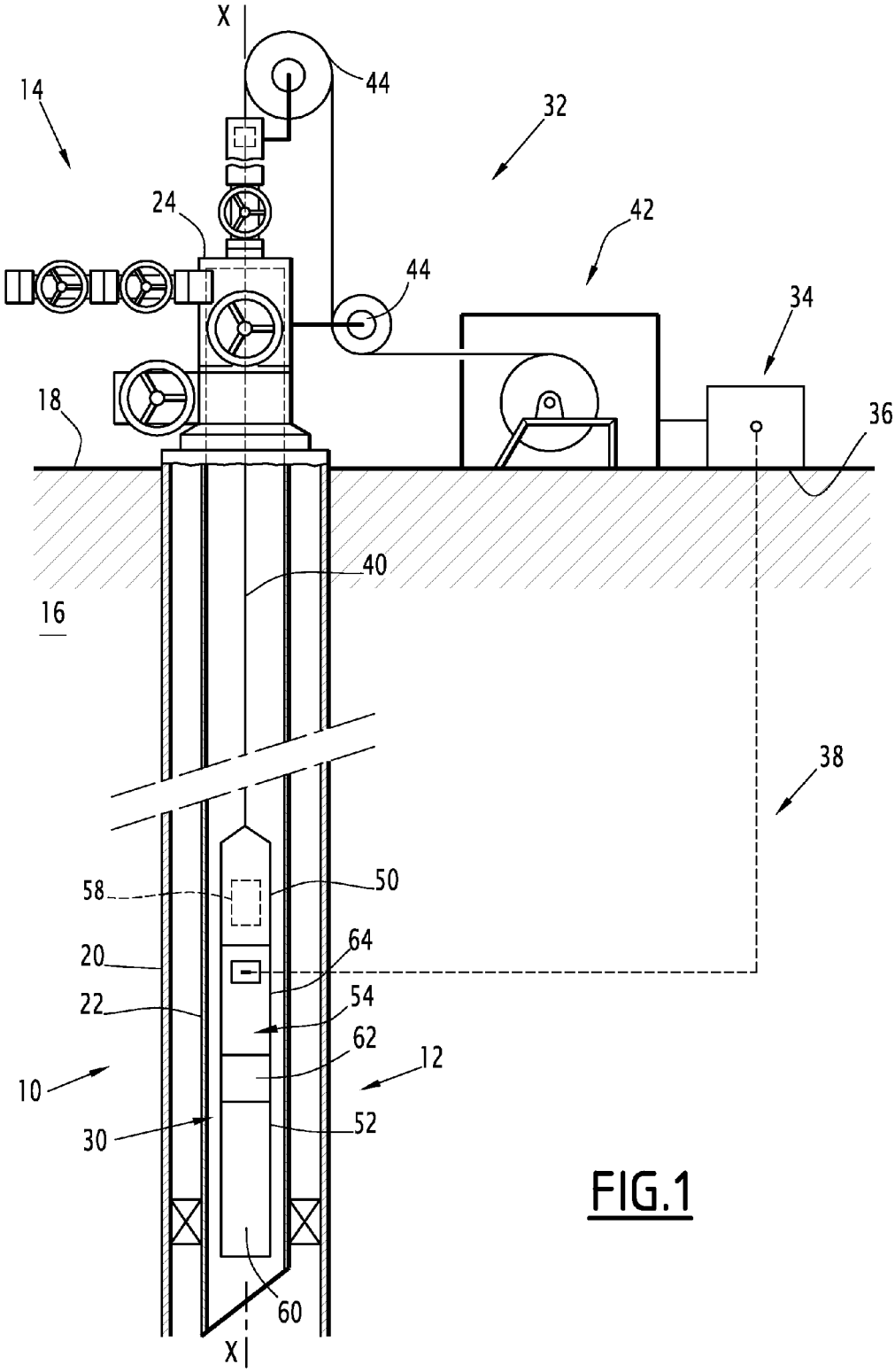
FIG. 1 is a diagrammatic partial cross-sectional view of a fluid exploitation installation according to the invention comprising a first lower assembly according to the invention introduced into a fluid exploitation well.

A first intervention device 10 according to the invention is shown in FIG. 1. This device 10 is intended to be lowered into a well 12 of a hydrocarbon exploitation installation 14, in particular an oil well. The well 12 is formed in the subsoil 16 to emerge at the surface 18 of the soil.

The well 12 comprises, in a known manner, at least one first nested pipe 20 called a "casing lining" and, situated the most at the center of the well 12, a last central pipe or tube 22 called "production tube" wedged substantially at the center of the or each first pipe 20.

The pipe 22 defines a central passage capable of conveying a production fluid from the bottom of the well 12 towards the surface 18. It has a length smaller than that of the pipe with a smaller diameter such that it emerges at its lower end towards the bottom of a lower section of the pipe 20.

The well 12 also comprises a wellhead 24 on the surface to selectively close and control the or each first pipe 20 and the second pipe 22, as well as the annular spaces defined between the pipes 20, 22.

The intervention device 10 comprises a lower assembly 30 according to the invention intended to be introduced into a pipe 20, 22 to perform an intervention and/or measuring operation there, a tool 32 for deploying the lower assembly 30 in the well, a controller 34 controlling the device 10 placed outside the pipe 22 at a first point 36 situated near the wellhead 24 on the surface 18 of the soil, and a transmitter 38 between the controller 34 and the lower assembly 30.

The lower assembly 30 can be placed indifferently in the second pipe 22 or in the lower section of the pipe 20 with a smaller diameter, below the lower end of the pipe 22. In all of the following, only the placement of the lower assembly in the pipe 22 will be described as an example.

In the example illustrated in FIG. 1, the tool 32 comprises a cable working line 40, a surface winch 42 allowing the deployment of the line 40 in the well 12 or its removal outside the well, and return pulleys 44 of the line 40, mounted on the wellhead 24.

The line 40 is for example formed by a single-strand smooth cable of the "piano wire" type, commonly referred to as a "slickline," advantageously with an electrically insulating coating on its outer surface, as described in patent application FR-A-2 848 363 by the Applicant.

Alternatively, a standard slickline is used with transmitter 38 other than those described in FR-A-2 848 363 such as: acoustic, vibrating.

In another alternative, the line 40 is a mechanically reinforced electrical cable, commonly referred to as an "electric line," or a hollow tube commonly referred to as "coiled tubing."

The winch 42 is connected to the controller 34. Under the action of the controller 34, the winch 42 and the pulleys 44 are capable of deploying the working line 40 in the second channel 22 through the wellhead 24 or retracting it towards the surface.

The lower assembly 30 generally has an elongated tubular shape with an axis X-X' substantially parallel to or combined with the local axis of the channel 22. In the example shown in FIG. 1 the axis X-X' is vertical, but it could be inclined in the case of a deviated well.

Figure 2:
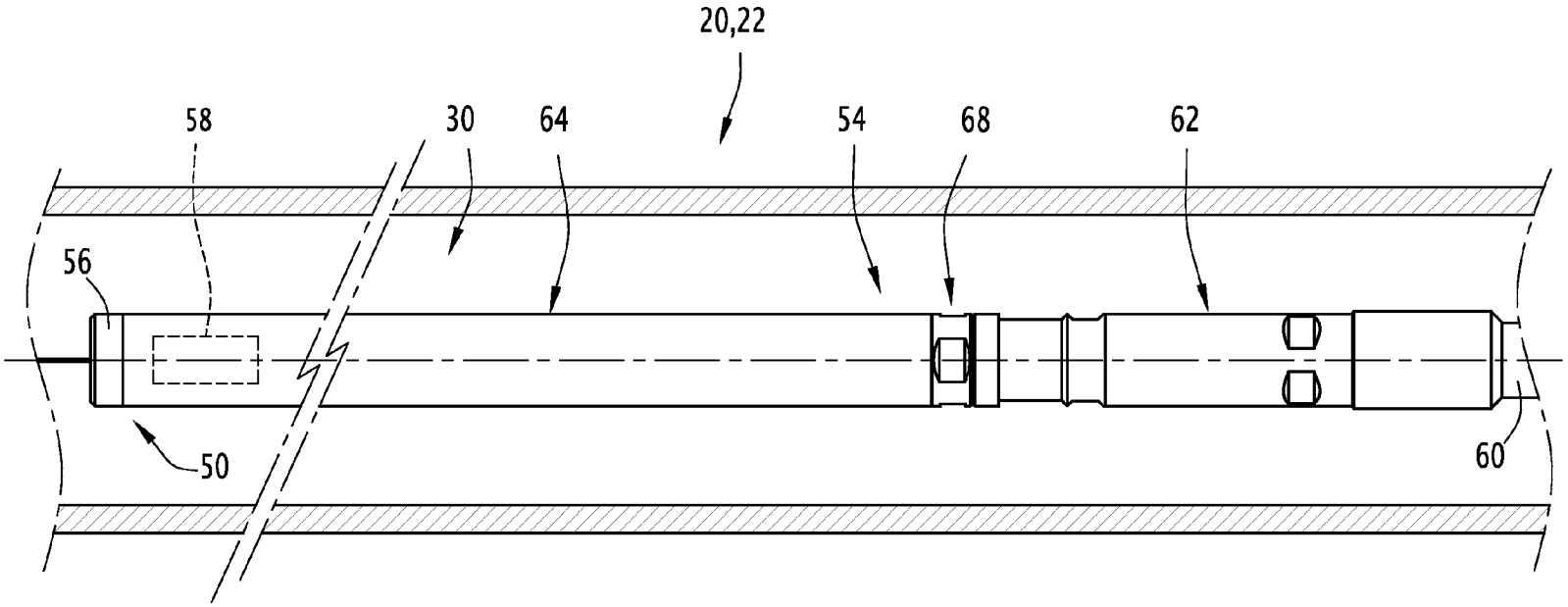
FIG. 2 is an elevation view of the lower assembly of FIG. 1 comprising a first disconnecting tool according to the invention occupying a connected position.

In reference to FIG. 2, the lower assembly 30 comprises, from top to bottom in that figure, an upper assembly 50 connected to the cable working line 40, a lower intervention and/or measuring assembly 52, and an intermediate disconnecting tool 54 according to the invention placed between the lower assembly 52 and the upper assembly 50.

The upper assembly 50 comprises, in reference to FIG. 2, a connector 56 connecting to the cable working line 40 and, advantageously, an instrumentation 58 that can for example comprise a sensor for measuring the local voltage applied on the line 40, sensors for detecting the position of the lower assembly 30 such as a "casing collar locator," or a sensor for detecting gamma radiation emitted by the formation. All of these sensors, which can be fragile and are relatively costly, are situated above the disconnecting tool 54 to be able to be retrieved in the event the lower assembly 52 is blocked.

The lower assembly 52 comprises at least one intervention and/or measuring tool 60. This tool 60 is for example a mechanical actuator, a perforating tool, or a measuring assembly intended to be used at a given point of the well 12.

The intermediate tool 54 is advantageously mounted at any point of the lower assembly 30.

Figure 3:
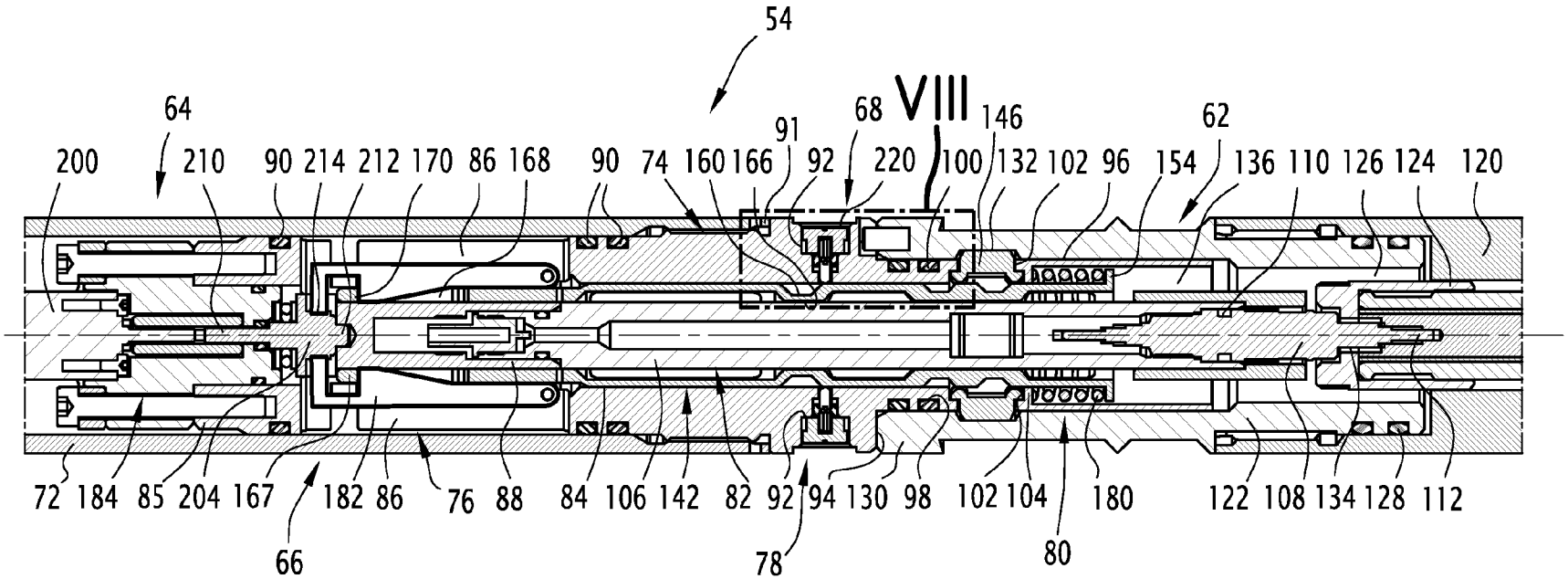
FIG. 3 is a cross-sectional view along a median axial plane of the relevant parts of the tool of FIG. 2.
Figure 5:
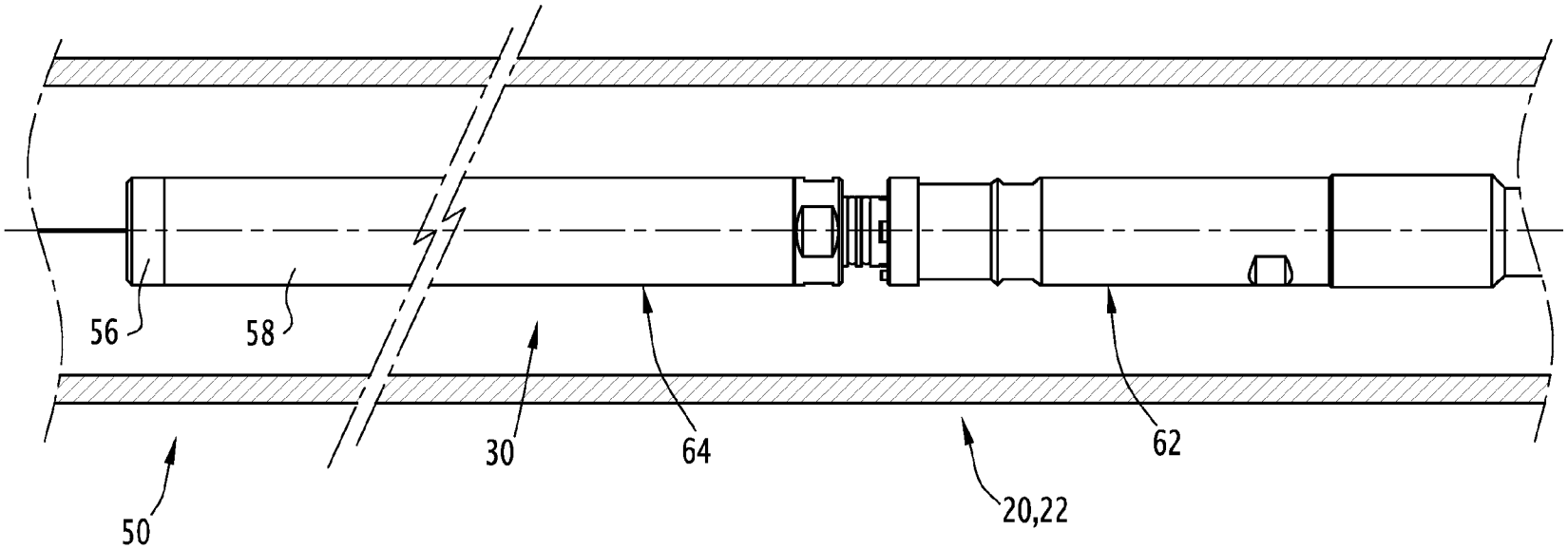
FIG. 5 is a view similar to FIG. 2 in a disconnected position of the tool.

It comprises, in reference to FIGS. 2 and 3, a lower portion 62 connected to the lower assembly 52, an upper portion 64 connected to the upper assembly 50, the lower portion 62 and the upper portion 64 being able to move relative to each other between a connected position, shown in FIG. 2, and a completely disconnected position, shown in FIG. 5.

Figure 4:
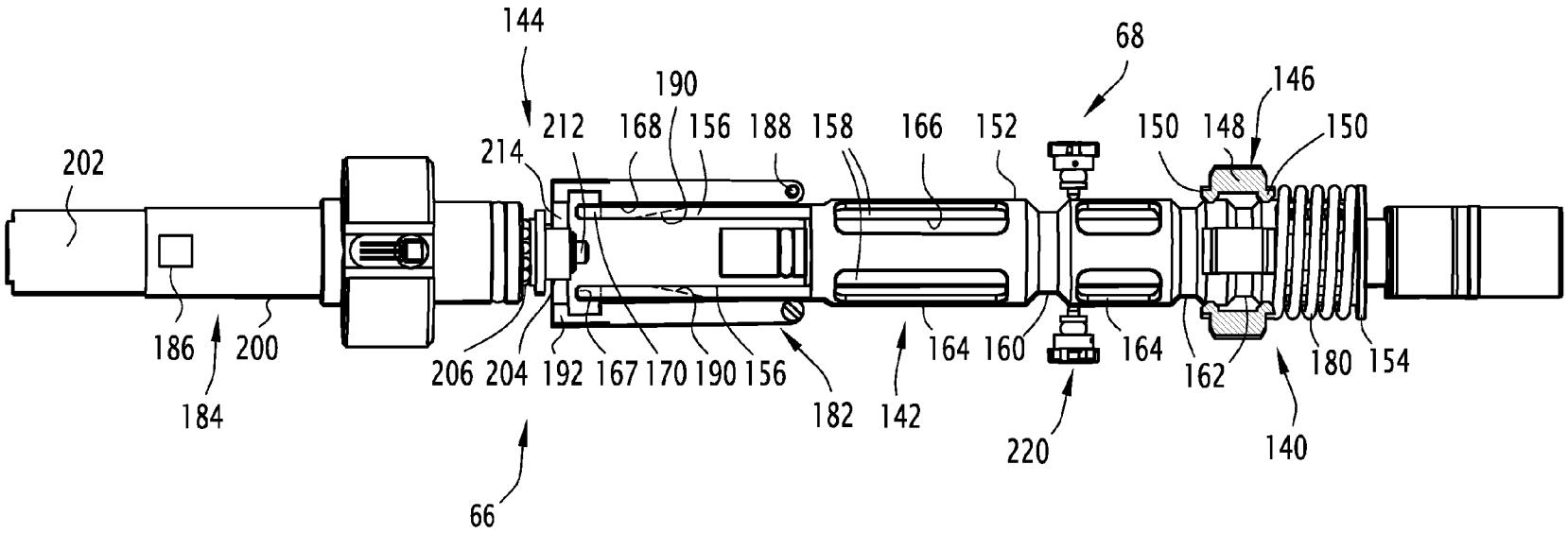
FIG. 4 is a side view of the connecting mechanism between the upper portion and the lower portion of the tool of FIG. 2 in the connected position.

In reference to FIGS. 3 and 4, the intermediate tool 54 also comprises an immobilizing assembly 66 that can be released from the lower portion 62 relative to the portion 64 in their connected position, a pressure equalization assembly 68 to allow the removal of the upper portion 64 relative to the lower portion 62 in the disconnected position, and a disconnectable electrical path 70 passing through the intermediate tool 54 to electrically connect the upper assembly 50 to the lower assembly 52.

The upper portion 64 comprises a lower sleeve 72 and a connecting head 74 mounted at a lower end of the sleeve 72.

The lower sleeve 72 has a cylindrical tubular shape with axis X-X'. It is fastened under the upper assembly 50.

The head 74 has a generally elongated shape along X-X'. It is mounted in an inner lumen defined at the lower end of the sleeve 72.

The head 74 comprises an upper region 76 inserted in the sleeve 72, an intermediate closing region 78 towards the bottom of the sleeve 72 and a lower region 80 that protrudes outside the sleeve 72 to be received in the lower portion 62. The head 74 also comprises a central rod 82 for passage of the electrical path 70.

The head 74 defines an upper passage 84 for receiving the releasable immobilizing assembly 66 extending along the axis X-X' over the entire length thereof and emerges at the upper end 85 of the head.

The upper region 76 defines, near its upper end 85, two lateral slots 86 for passage of the retaining hooks for retaining the immobilizing assembly 66, as will be seen below.

The slots 86 emerge transversely towards the outside opposite the sleeve 72 and emerge inwardly in the receiving passage 84.

The upper region 76 comprises, opposite the slots 86 around the axis X-X', a cylindrical core 88 arranged in the passage 84 along the axis X-X'. The core 88 has an outer diameter smaller than the passage diameter 84.

The upper region 76 is sealably mounted in the upper sleeve 72 via annular sealing rings 90 distributed over its length. Thus, the penetration of fluid outside the intermediate tool 54 between the upper region 76 and the sleeve 72 is prevented.

The intermediate region 78 extends bearing on the lower edge 91 of the sleeve 72. It has an outer diameter substantially equal to that of the sleeve 72. It defines two radial pressure equalization orifices 92 that connect the central passage 84 and the outside of the tool 54. Each orifice 92 has an outer portion with a larger diameter than its inner portion.

The lower region 80 has a diameter smaller than the diameter of the intermediate region 78. The lower region 80 thus defines, with the intermediate region 78, a lower annular bearing shoulder 94 intended to receive the upper edge of the lower portion 62.

The lower region 80 has a substantially cylindrical outer surface 96 with a constant diameter and axis X-X'. It defines annular cavities 98 for receiving intermediate annular sealing rings 100 intended to be pressed against an inner surface of the lower portion 62 of the tool 54, as will be described below.

The lower region 80 also defines, below the cavities 98, radial windows 102 for the passage of locking clips for locking the releasable immobilization assembly 66. The windows 102 emerge inwardly in the reception passage 84.

The lower region 80 also comprises an annular stop 104 for axial wedging of the clips. The stop 104 extends below the windows 102 protruding radially towards the axis X-X' in the reception passage 84.

The central rod 82 comprises a tubular conveyance member 106 and a connecting head 108.

The tubular member 106 is attached, at its upper end, on the cylindrical core 88. It extends along the axis X-X' in the reception passage 84, successively opposite the upper region 76, the intermediate region 78 and the lower region 80, beyond which it protrudes downwardly.

It defines, at its periphery in the reception passage 84, an annular circulation space of the releasable immobilization assembly 66.

The head 108 axially closes the lower end 110 of the tubular member 106. It has, at its free end, a point 112 for electrical connection to the lower portion 62 of the tool.

The lower portion 62 comprises a lower sleeve 120, a hollow upper jacket 122 for receiving the connecting head 74, and an electrical connecting core 124 mounted coaxially in the lower sleeve 120 to protrude in the jacket 122.

The sleeve 120, the jacket 122 and the core 124 inwardly define a lower passage 126 for receiving the head 74 emerging upwardly.

The jacket 122 has a substantially cylindrical shape. It is sealably mounted in an upper cavity of the sleeve 120 with insertion of lower sealing rings 128.

The jacket 122 has an inner diameter, outwardly defining the lower passage 126, with a diameter substantially equal to the outer diameter of the surface 96 of the lower region 80.

It defines, near its upper edge 130, an annular groove 132 for receiving clips of the releasable immobilization assembly 86 that has a diameter larger than that of the lower passage 126. The groove 132 extends opposite the windows 102 in the connected position.

The core 124 protrudes in the lower passage 126 alone the axis X-X'. It defines an axial housing 134 for receiving the point 112. The housing 134 has a shape substantially complementary to that of the point 112 to ensure electrical continuity when the point 112 is inserted in the core 124.

The electrical path 70 has a lower section (not shown) extending through the core to the axial housing 134, an intermediate section extending through the connection head 108 and through the tubular member 106, and an upper section (not shown) extending through the upper portion 64. It has at least one breakable or disconnectable region. In this example, the disconnectable region is formed by the point 112.

When the upper portion 64 and the lower portion 62 occupy their connected position, the point 112 being received in the core 124, an electrical signal can be transmitted through the path 70 from an upper portion of the lower assembly 30 towards the tools positioned in the lower portion of the lower assembly 30.

In the disconnected position, the path 70 is broken and the electrical circuit is opened.

Figure 6:
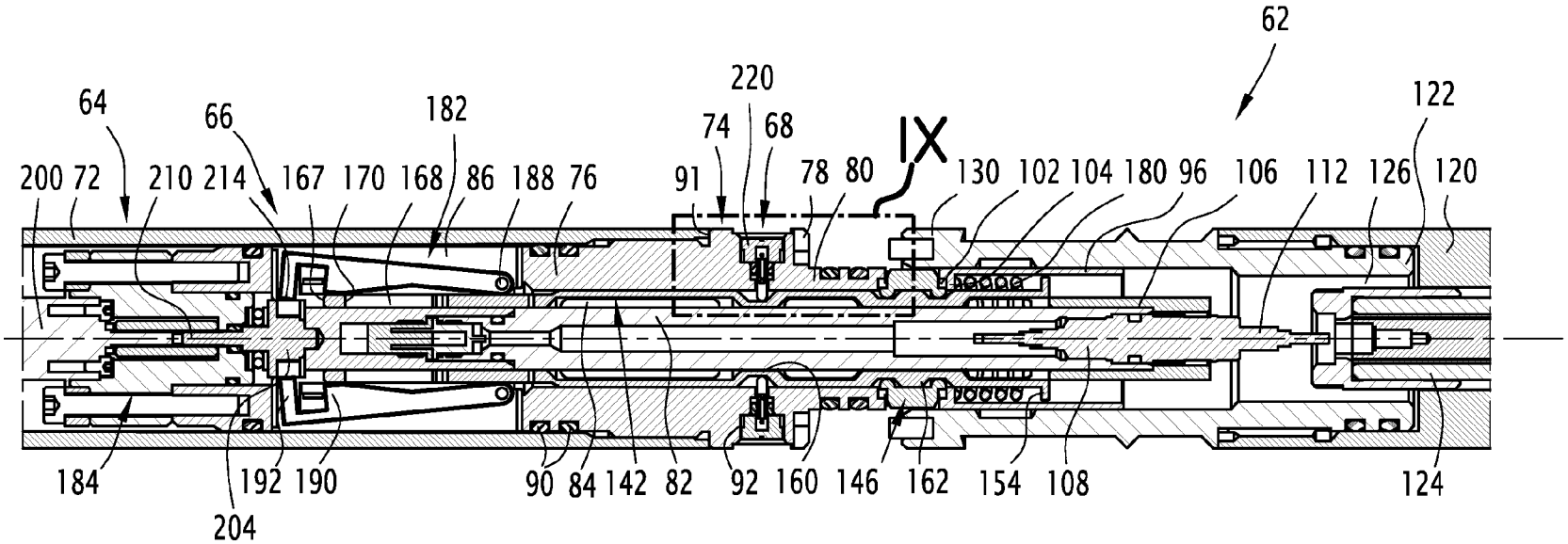
FIG. 6 is a view similar to FIG. 3 in the disconnected position.

As seen above, the lower portion 62 and the upper portion 64 can move relative to each other between a connected position, shown in FIGS. 2 and 3, and the completely disconnected position shown in part in FIGS. 5 and 6.

In the connected position shown in FIGS. 2 and 3, the head 74 has been introduced into the lower reception passage 126 defined by the jacket 122 and by the lower sleeve 120 of the lower portion 62.

The upper edge 130 of the jacket 122 is arranged bearing on the lower annular shoulder 94. The intermediate sealing rings 98 bear radially against an inner surface of the jacket 122 around the lower edge 94 below windows 102.

Thus, the upper reception passage 84 and the lower reception passage 126 communicate with each other and form a sealed cavity 136 emerging towards the outside exclusively via the pressure equalization orifices 92.

The connecting head 108 protrudes in the lower passage 126, and the point 112 is received in the housing 134.

In the disconnected position, the upper portion 64 has been axially offset relative to the lower portion 62.

The upper edge 130 of the jacket 122 has been placed away from the lower shoulder 94. The point 112 has been removed outside the housing 134.

The upper portion 64 is then capable of being moved completely away from the lower portion 62 to no longer be in contact therewith. In this position, the inner cavity 136 has been completely opened and the assembly formed by the upper assembly 50 and the lower assembly 64 is capable of being raised to the surface by the cable working line 40, independently of the assembly formed by the lower portion 62 and the lower assembly 52.

Figure 7:
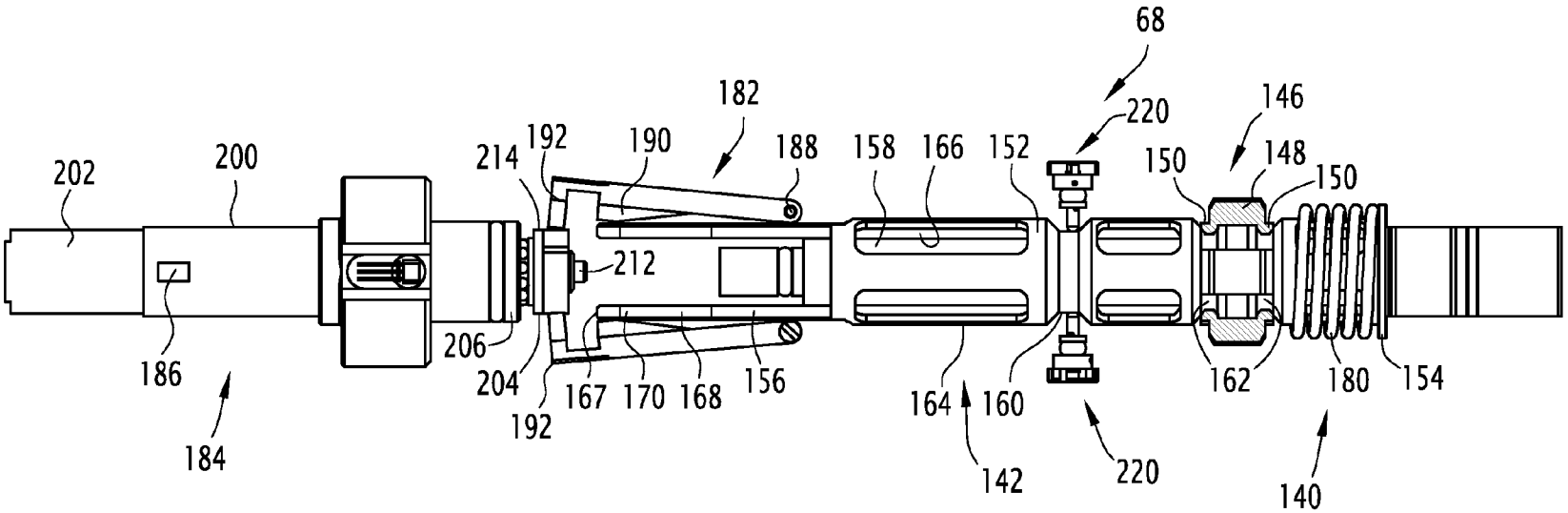
FIG. 7 is a view similar to FIG. 4 in the disconnected position.

As illustrated by FIGS. 4 and 7, the releasable immobilization assembly 66 comprises releasable members 140 for axial immobilization of the lower portion 62 relative to the upper portion 64, a mobile release member 142 of the immobilization members 140 and a mechanism 144 for moving the release member 142.

In this example, the immobilization members 140 are formed by radial clips 146 mounted so as to be radially movable in the windows 102.

Each clip 146 comprises a head 148 capable of protruding radially beyond the outer surface 96 of the head 74 in the groove 132 and actuating feet 150 for deploying the clips 146.

Each clip 146 can be moved between a radially deployed position for axial blockage of the lower portion 62 relative to the upper portion 64, and a radially retracted position for releasing the upper portion 64 relative to the lower portion 62.

In the radially deployed position, the head 148 of each clip 146 protrudes outwardly beyond the outer surface 96 to be received in the groove 132. The feet 150 are then arranged bearing against an inner surface of the head 74 around the window 102.

In the retracted position, the head 148 is radially flush with the outer surface 96. The feet 150 then protrude radially towards the axis X-X'.

The release member 142 is received in the upper passage 84. It has a substantially cylindrical openwork body 152, a lower flange 154 and two upper legs 156 for axial retention.

The openwork body 152 defines a plurality of axial lumens 158, an upper circumferential throttle 160 for receiving the pressure equalization assembly 68, and two lower circumferential throttles 162 for receiving clips 146.

The openwork body 152 thus has a substantially cylindrical outer peripheral surface 164 and a substantially cylindrical inner peripheral surface 166.

The outer surface 164 is arranged bearing against the intermediate region 78 and the lower region 80 of the head 74 in the reception passage 84, away from the throttles 160, 162. The inner surface 166 is arranged bearing against the central rod 82 opposite the throttles 160, 162.

The upper legs 156 define, near their upper edge, lateral orifices 168 for receiving blocking hooks. The lateral orifices 168 are defined towards the top by a transverse retaining surface 170.

The flange 154 protrudes radially relative to the openwork body 152, at the lower end of the openwork body 152.

The release member 42 is slidingly mounted in the annular space defined in the reception passage 84 by the central rod 82 and by the head 74, between an upper position for activating the immobilization members, shown in FIGS. 3 and 4, and a lower position for releasing the immobilization members, shown in FIGS. 6 and 7.

The movement mechanism 144 comprises a stressing spring 180 for stressing the release member 142 towards the release position, hooks 182 for axially retaining the release member 142 in the activation position against the spring 180, and an actuator 184 capable of releasing the hooks 182 upon receiving a command signal transmitted by the transmitter 38.

The mechanism 144 also comprises a receptor 186 receiving the control signal coming from the surface to control the actuator 184.

The stressing spring 180 is mounted bearing between the flange 154 and the annular stop 104. It exerts an axial stressing force aiming to move the flange 154 away from the stop 104 at least in the activation position.

The hooks 182 are pivotably mounted in the slots 86. Each hook 182 is thus hinged on the upper portion 76 of the head 74 by its lower end around an axis 188 perpendicular to the axis X-X'.

Each hook 182 comprises a radial retaining protrusion 190, arranged near and away from its free end, and an actuating finger 192 that protrudes radially towards the axis X-X' at its free end.

The hook 182 can be moved by pivoting around the axis 188 between an engaged position in the release member 142 and a disengaged position of the release member 142 situated radially spaced away from the axis X-X.

In the engaged position, the finger 192 extends substantially perpendicular to the axis X-X'. The radial stop 190 is arranged in the orifice 168 in contact with the transverse retaining surface 170.

In the disengaged position, the hook 182 has been pivoted around its upper end 188 in a slot 86. The radial stop 190 has been removed towards the exterior outside the orifice 168 and the finger 192 has been transversely offset away from the axis X-X'.

The actuator 184 is received completely in the intermediate tool 54, in the upper portion 64. It is housed in the lower sleeve 72 and is attached below the upper region 76 of the head 74.

The actuator 184 comprises an electric motor 200, a battery 202 for powering the electric motor 200, and a cam 204 for actuating hooks 182 driven in rotation by the motor 200.

The actuator 184 also comprises an intermediate bearing assembly 206 for mounting the cam 204 on the motor 200.

The motor 200 is low power, in particular with power less than 5 watts, advantageously less than or substantially equal to 1 watt. It has an output shaft 206 with axis X-X' mechanically connected to the cam 204 via the assembly 206.

Figure 10:
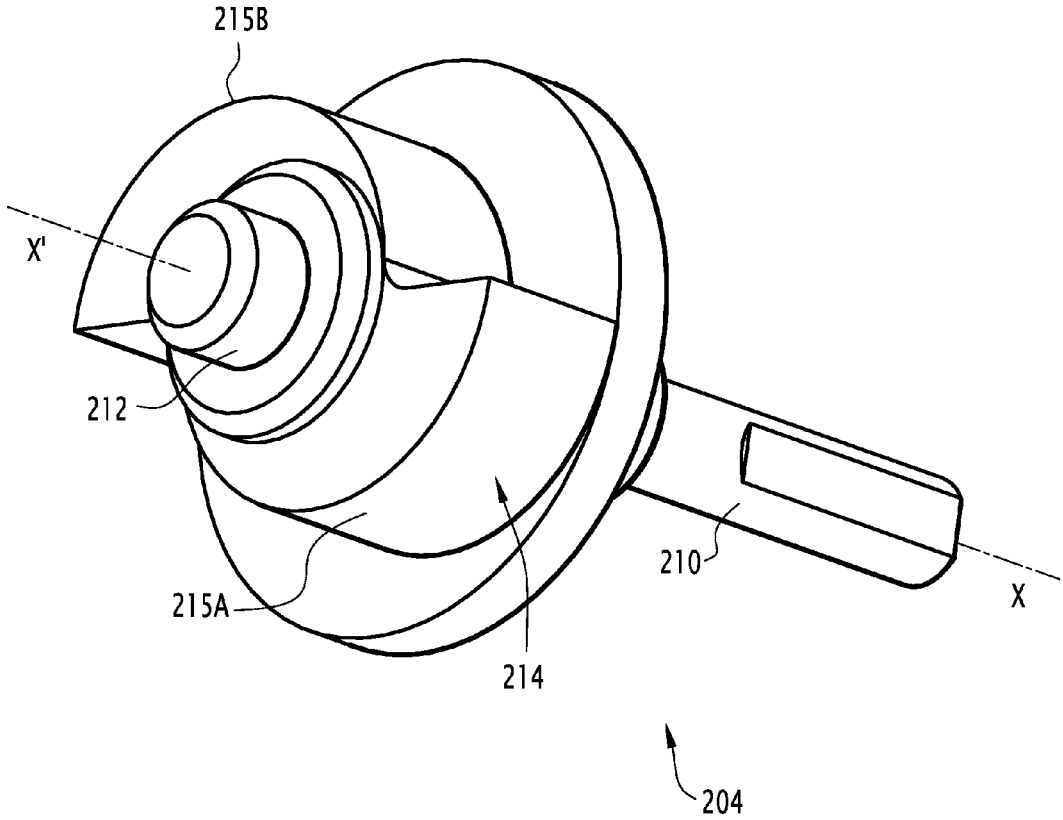
FIG. 10 is a view of the actuating cam of the actuating mechanism of the tool shown in FIG. 3.

In reference to FIG. 10, the cam 204 comprises an input shaft 210, a head 212 and a peripheral cam surface 214 extending circumferentially around the axis X-X'.

The head 212 is received in an orifice formed at the upper end of the cylindrical core 88. The input shaft 210 is mechanically secured to the output shaft 206 of the motor 200 to be driven in rotation jointly with the shaft 206, possibly with the aid of a decoupling mechanism, such as a reduction gear.

The cam surface 214 comprises a first peripheral region 215A in the shape of a half-moon intended to be placed in contact with a first hook 182 and a second opposite peripheral region 215B in the shape of a half-moon intended to be engaged with a second hook 182.

The regions 215A, 215B are configured such that the distance separating the axis X-X' of rotation of the cam 204 from the contact point between each peripheral region 215A, 215B of the cam surface 214 and the associated hook 182 gradually increases during pivoting of the cam 204 around the axis X-X' in a first direction.

The cam 204 is thus rotatably mounted around the axis X-X' under the action of the motor 200 to make the hooks 182 go from their engaged position in the release member 142 to their disengaged position outside the member 142 by gradually moving the fingers 192 away from the axis X-X'.

The receptor 186 is coupled to the transmitter 38 to receive the control signal emitted by the transmitter 38.

They are adapted to supply the electric motor 200 using the battery 202 to drive the cam 204 in rotation in the first direction upon receiving a control signal coming from the surface.

Figure 8:
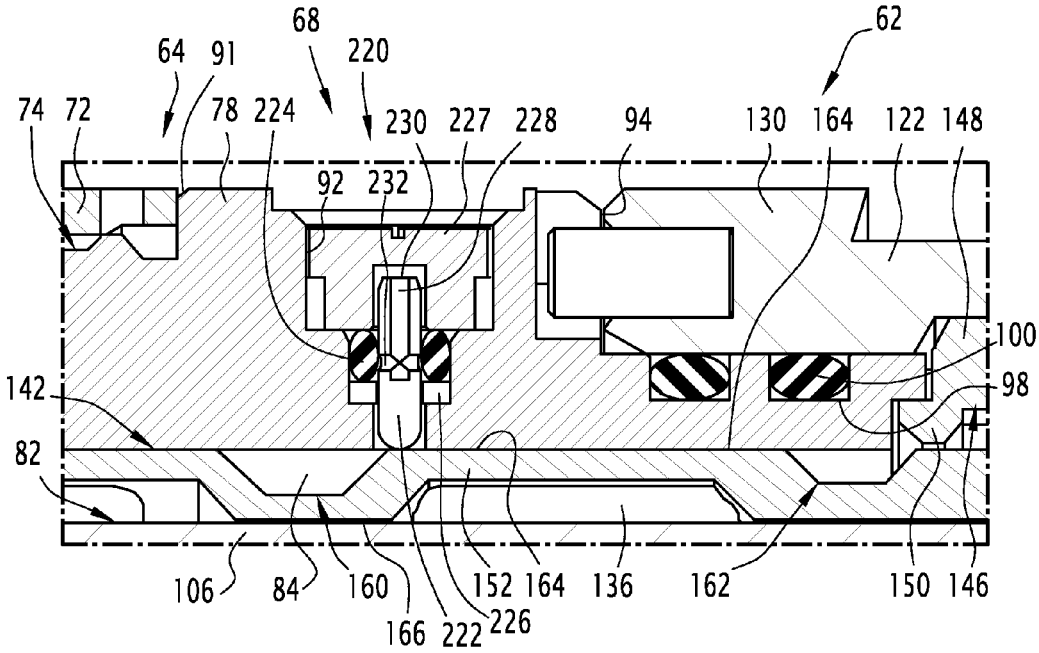
FIG. 8 is a view of a detail marked VIII in FIG. 3.
Figure 9:
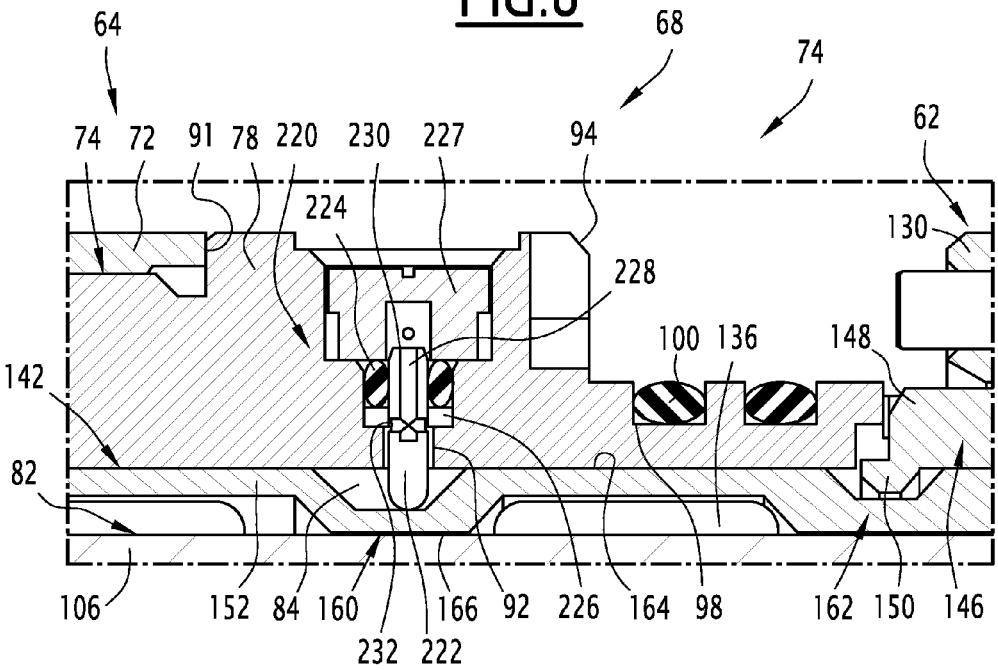
FIG. 9 is a view of a detail marked IX in FIG. 6.

In reference to FIGS. 8 and 9, the pressure equalization assembly 68 comprises a pressure equalization member 200 for each pressure equalization orifice 92.

The pressure equalization member 200 comprises a pierced rod 222, an annular joint 224 arranged around the pierced rod 222, an inner support washer 226 of the joint 224, and a closure plug 227 outwardly closing the orifice 92.

The rod 222 extends longitudinally in the inner portion of the orifice 92. It has an inner channel 228 with an axis Y-Y' that is transverse relative to the axis X-X'.

The channel 228 emerges outwardly along the transverse axis Y-Y' opposite the plug 227 through an upstream opening 230. It emerges downstream through downstream opening 232 arranged perpendicular to the axis Y-Y' of the rod 222 substantially in a median portion of the rod 222.

The washer 226 and the joint 224 are arranged around the rod 222 in the upper portion thereof. An annular space exists below the washer 226 towards the inner cavity between the rod 222 and the intermediate portion 78 defining the orifice 92.

The rod 222 is radially mobile relative to the axis X-X' along its axis Y-Y' between an outer closing configuration to maintain sealing in the inner cavity 136 shown in FIG. 8 and an inner pressure equalization configuration, shown in FIG. 9.

In the outer configuration, the rod 222 is deployed outside the inner cavity 136 and the reception passage 84. It protrudes partially in the plug 227.

The downstream openings 232 then emerge opposite the annular joint 224, and the channel 228 is closed from the outside towards the inside. The pressure equalization orifice 92 is then sealably closed by the pressure equalization member 220.

In the inner configuration, the rod 222 has been radially moved towards the axis X-X' under the effect of the outside fluid pressure. It protrudes partially in the reception passage 84, in the inner cavity 136.

The openings 232 extend at least partially under the washer 226 opposite the annular space defined between the rod 222 and the intermediate region 78 of the head 74.

A continuous fluid path is formed from the outside of the tool 54 through the plug 227, the upstream inlet 230 of the channel 228, the channel 228, the downstream opening, the annular space and the reception passage 84 to make it possible to equalize the pressure between the inner cavity 146 and the outside of the tool 54.

The transmitter 38 is capable of transmitting each control signal (for each of the tools present in the lower assembly 30, including the intermediate tool 54), from the surface control means 34 towards the receptor 186 in the actuator 122.

In the example shown in FIGS. 1 to 10, the transmitter 38 is of the type described in French application FR-A-2 848 363 by the Applicant. It operates by circulation of each control signal between the controller 34 and the receptor 186, along the cable working line 40 and the second channel 22.

Alternatively, an electrical, acoustic, magnetic, mechanical, or electromechanical transmitter 38 is used.

The operation of the intermediate disconnecting tool 54 during lowering of the lower assembly 30 will now be described.

Initially, the lower assembly 30 is assembled on the surface 18 of the well 12. The intermediate tool 54 is placed in its connected position, with the lower portion 62 connected on the upper portion 64.

In this position, as specified above, the head 74 has been inserted in the lower reception passage 126 defined by the upper jacket 122 and the lower sleeve 120. The lower shoulder 94 is positioned bearing against the upper edge 130 of the jacket 122.

The connection head 108 is inserted in the housing 134 to electrically connect the upper portion 64 of the tool 54 with the lower portion 62 of the tool 54 through the central rod 82.

The release member 142 is placed in its upper activation position. To that end, its upper edge extends relatively near the cam 204.

The retaining hooks 182 occupy their engaged position, inserted in the reception orifices 168 and the radial stops 190 are pressed against the upper transverse retaining surface 170. The hooks 182 then extend substantially parallel to the axis X-X'.

The fingers 192 are applied against the outer surface of the cam 214, as close as possible to the axis X-X'.

In this position, the stressing spring 180 is kept compressed between the flange 154 and the annular stop 104, the flange 154 being situated as close as possible to the stop 104.

In this connected position, the intermediate annular throttle 160 is axially offset relative to each pressure equalization orifice 92. The outer peripheral surface 164 of the release member 142 inwardly closes the pressure equalization orifices 92.

The pressure equalization members 220 are then mounted. Each rod 222 is introduced into an orifice 92 by placing the washer 226 and the annular joint 224 around it. The lower end of the rod 222 is made to abut against the outer peripheral surface 164 of the release member 142, to keep the rod 222 in its outer sealing position.

Likewise, the lower throttles 162 are axially offset along the axis X-X' relative to the feet 150 of the clips 146. The feet 150 are therefore outwardly pressed on the outer peripheral surface 164 away from the throttles 162, which keeps the clips 146 in their outwardly deployed position through the windows 102.

The head 148 of the clips 146 is received in the annular groove 132, which axially blocks the upper portion 62 along the axis X-X' relative to the upper portion 64.

The lower joints 128, the intermediate joints 102 and the upper joints 90 sealably close, with the annular joints 224 of the pressure equalization members 220, the cavity 136 formed by the upper reception passage 84 and by the lower reception passage 126.

Thus, all of the instrumentation received in the cavity 136 as well as the devices and electrical paths 70 received in said cavity 136 are kept isolated from the fluid present outside the tool 54.

Then, the lower assembly 52 is mounted under the lower portion 62 of the tool 54, and the upper assembly 50 comprising the instrumentation 58 and the connector 56 is mounted above the upper portion 64.

Then, the connector 56 is connected to the cable working line 40 and the lower assembly 30 thus formed is introduced into the well 12 using a lock mounted on the wellhead 24.

The lower assembly 30 is then lowered towards the bottom of the well 12 by the cable working line 40 to a chosen point to perform an intervention and/or measurements.

In the event of a problem moving the lower assembly 30 before or after the intervention, and in particular if the lower intervention and/or measuring assembly 52 remains blocked, preventing the lower assembly 30 from coming back up towards the surface, the cable working line 40 is immobilized.

Under the control of the surface operator, the transmitter 38 transmits a control signal to the actuator 184. This control signal is sufficiently secured to avoid erroneous disconnection.

When the control signal is received by the receptor 186, the receptor 186 activates the electric motor 200 using the battery 202 present in the disconnecting tool 54.

It is therefore not necessary to have an electrical line transferring electrical power between the surface and the bottom to perform the disconnection.

Thus, it is possible to proceed with a disconnection even when the lower assembly 30 is lowered using a cable working line of the insulated slickline type as described in application FR-A-2 848 363 by the Applicant.

Under the effect of the activation of the motor 200, the cam 204 begins to rotate around the axis X-X', which moves the cam surface 214 around the axis X-X' relative to the fingers 192.

The fingers 192 then pass over the region of the cam surface 214 situated farthest from the axis X-X', which causes them to pivot around the axis 188.

During this pivoting, the radial stops 190 move outwardly away from the transverse retaining surfaces 170 and leave the reception orifices 168.

The radial stops 190 being disengaged, the spring 180 is free to axially deploy to move the flange 154 axially away from the stop 104.

During this movement, and under the effect of the spring 180, the release member 142 goes from its upper activation position to its lower release position. It descends axially relative to the upper portion 64 while sliding along the axis X-X' in the annular space defined in the upper reception passage 84 between the intermediate portion 74 and the central rod 82.

This movement is guided by the sliding of the inner peripheral surface 166 on the rod 82 and by the sliding of the outer peripheral surface 164 against the intermediate region 74.

When the release member 142 occupies its release position, its upper edge 167 has moved away relative to the cam 204.

The lower throttles 162 are then placed opposite the feet 150 of the clips 146, which allows a radial movement of the clips 146 from their deployed position towards their retracted position.

The clips 146 therefore retract away from the groove 132 while being received in the lower throttles 162.

At the same time, the upper throttle 160 is situated opposite the pressure equalization orifices 92. The rods 222 are then free to move radially inwardly, under the effect of the outside pressure, towards their inner configuration bearing against the bottom of the lower throttle 160.

The pressure between the outside of the tool 54 and the inner cavity 136 then equalizes through circulation of fluid successively through the plug 227, the channel 228 and the pressure equalization orifice 92 around the rod 222 to the inner cavity 136.

The lower portion 62 is then no longer mechanically retained relative to the upper portion 64. Moreover, there is no longer any pressure difference between the inner cavity 146 and the outside of the tool 54 capable of axially retaining the upper portion 64 relative to the lower portion 62.

The cable working line 40 is thus activated to upwardly raise the assembly formed by the upper assembly 50 and the upper portion 64 of the disconnecting tool 54.

During this movement, the head 74 comes out of the lower reception passage 126 and the electrical path 70 disconnects by extraction of the connecting point 112 outside the housing 126 and possibly by breaking of a frangible wire.

Once this is done, the assembly formed by the upper assembly 50 and the lower portion 62 of the tool, which in particular includes the fragile and costly instrumentation, is retrieved without any risk of breaking the cable working line 40, and without it being necessary to move the assembly formed by the lower assembly 52 and the lower portion 62 of the disconnecting tool 54.

Later, fishing for the assembly formed by the lower assembly 52 and the lower portion 62 of the intermediate tool 54 can be done, with suitable means such as a line with greater mechanical resistance.

It will be noted that the jacket 122 of the lower portion 62 is inwardly profiled to engage a fishing tool for example arranged at the lower end of a cable with a high mechanical strength such as a coiled tubing, or at the lower end of a group of rods.

The emergency disconnecting tool 54 is therefore particularly easy to implement, since it is completely autonomous in terms of energy.

It does not require that significant force be exerted on the cable working line to allow the disconnection, since that disconnection is controlled directly in the tool 54 by the actuator 184 under a command transmitted by a transmitter of a control signal between the bottom and the surface.

Moreover, the pressure equalization being done at the same time as the mechanical release of the lower portion 62 relative to the upper portion 64, there is no risk of blocking the tool 54 in its connected position.

The tool 54 also has a smaller length. It is very resistant to the environment in which it is submerged, due to the sealing between the upper portion 64 and the lower portion 62. It is thus possible to make an electrical path 70 pass through the disconnecting tool 54 without risk of contamination by the outside environment.

In one alternative, the tool 54 comprises a switch capable of opening the electrical path 70 to break the electrical continuity and power from the upper portion of the lower assembly 30 towards the lower portion of the lower assembly 30, so as to avoid any short circuit with the well fluid. This switch is activated upon receipt of the control signal by the receptor 186.

The presence of at least one pressure equalization member 220 received in a pressure equalization orifice 92 and distinct from the release member 142, to be kept in a closing configuration of the pressure equalization orifice 92 before disconnection, then to go to a pressure equalization configuration when the release member 142 moves in its activation position, improves the reliability of the tool, since it guarantees that the pressure equalization indeed occurs.

Moreover, as indicated above, the intermediate tool 54 advantageously defines a plurality of pressure equalization orifices 92 emerging radially outside the tool 54, which further strengthens the reliability of its opening.

It will be noted that the presence of pressure equalization orifices 92, which emerge radially outside the tool 54 and which connect the central passage 84 to the outside of the tool 54, allow easy assembly and disassembly of the pressure equalization members 220 and the plugs 227. It is thus easy to assemble these members 220, without completely disassembling the tool 54, and in particular the upper portion of the tool 54.

In one alternative, the lower assembly 30 includes a delayed control device for the disconnection of the intermediate tool 54.

This device is for example made up of a retarder advantageously housed in the upper portion 64 of the intermediate tool 54.

The retarder is electrically connected to the receptor 186 by a transmitter 38 received in the tool 50.

The retarder is programmed on the surface to emit a control signal beyond a given intervention duration to be counted from its activation.

The lower assembly 30 is then introduced into the well, the tool 54 having its upper portion 64 and its lower portion 62 in their position connected one on the other. The retarder is then activated.

When the intervention duration predefined in the retarder is reached, the retarder emits a control signal that is received by the receptor 186 to actuate the actuator 184 and cause the disconnection of the upper portion 64 relative to the lower portion 62, as previously described.

In all of the preceding, the actuator 184 comprising the electric motor, the battery 202, and the receptor 186 for receiving the control signal are completely received in the upper portion 64 of the intermediate tool 54.

Subsequently, all of the sensitive electrical or electronic parts are raised up outside the well 12 with the upper portion 64, when the upper portion 64 is disconnected from the lower portion 62, which remains in the well 12.

It is not necessary, in certain cases, to have a battery or electronics present in the lower portion 62 or below the lower portion 62.

Thus, the lower assembly 30 can comprise a purely mechanical lower intervention assembly 52, without electrical path connected under the intermediate tool 54.

The invention claimed is:

1. An intermediate disconnecting tool, intended to be placed in a lower assembly lowered into a well, comprising:

an upper portion, intended to be connected to a cable working line, and a lower portion, intended to be connected to a bottom tool, the upper portion and the lower portion being mounted so as to move relative to each other between a connected position in which the upper and lower portions are connected on each other and a completely disconnected position, in which the upper portion can be raised to the surface independently of the lower portion, one of the upper portion and the lower portion defining a head, the other of the upper portion and the lower portion defining a receiving cavity receiving the head sealably in the connected position;

at least one immobilization member that can be freed from the upper portion relative to the lower portion in the connected position;

a release member for releasing the immobilization member, able to move between an activation position for activating the immobilization member and a release position for releasing the immobilization member;

a mechanism for moving the release member housed in the tool, the movement mechanism comprising an actuator including an energy source, and a receptor for receiving a control signal for powering the actuator via the energy source after receiving the control signal;

wherein the movement mechanism comprises at least one member for elastic stressing of the release member towards a release position and at least one retaining member for keeping the release member in an activation position against the stressing member, the actuator being able to release the retaining member after receiving the control signal, wherein the tool defines at least one pressure equalization orifice connecting the receiving cavity and the outside of the tool, the tool comprising a pressure equalization member able to move in the pressure equalization orifice between a closing configuration closing the pressure equalization orifice and a pressure equalization configuration through the pressure equalization orifice, the pressure equalization member being separate from the release member, the release member in the activation position keeping the pressure equalization member in the closing configuration, the release member in the release position allowing the movement of the pressure equalization member from the closing configuration towards the pressure equalization configuration.

2. The tool according to claim 1, wherein the pressure equalization member comprises a rod defining an inner channel, the inner channel being released in the pressure equalization configuration, the inner channel being closed in the closing configuration.

3. The tool according to claim 1, wherein the release member defines a housing for receiving the pressure equalization member emerging in a peripheral surface of the release member, the pressure equalization member being arranged in the receiving housing in the release position.

4. The tool according to claim 1 wherein the or each pressure equalization orifice extends radially relative to an axis (X-X') of extension of the tool.

5. The tool according to claim 1, wherein the actuator comprises an electric motor, the energy source comprising an electrical power battery of the electric motor.

6. The tool according to claim 5, wherein the electric motor has a power consumption of less than 5 watt.

7. The tool according to claim 1, wherein the actuator comprises a rotary cam, the retaining member cooperating with the rotary cam so that the rotation of the rotary cam disengages the retaining member from the release member.

8. The tool according to claim 7, wherein the retaining member comprises at least one pivoting hook having a free end engaged against the rotary cam.

9. The tool according to claim 1, wherein, the tool being arranged in the well, the receptor is configured to receive an electric, electromagnetic, magnetic, mechanical or acoustic control signal emitted from the surface, or a control signal received from a retarder carried by the tool.

10. The tool according to claim 1, wherein the actuator is completely received in the upper portion.

11. A lower assembly intended to be lowered in a well, comprising:

a connector for connecting to a cable working line;

at least one bottom tool; and the intermediate disconnecting tool according to claim 1, wherein at least in the disconnected position of the intermediate disconnecting tool, the connector is connected to the upper portion of the intermediate disconnecting tool, the bottom tool being connected to the lower portion of the intermediate disconnecting tool.

12. The lower assembly according to claim 11, further comprising at least one measuring tool inserted between the upper portion and the connector, the lower assembly comprising at least one intervention tool arranged under the lower portion.

13. The lower assembly according to claim 11, further comprising at least one measuring tool inserted between the upper portion and the connector, the lower assembly comprising at least one measuring tool arranged under the lower portion.

14. An intermediate disconnecting tool, intended to be placed in a lower assembly lowered into a well, comprising:

an upper portion, intended to be connected to a cable working line, and a lower portion, intended to be connected to a bottom tool, the upper portion and the lower portion being mounted so as to move relative to each other between a connected position in which the upper and lower portions are connected on each other and a completely disconnected position, in which the upper portion can be raised to the surface independently of the lower portion, one of the upper portion and the lower portion defining a head, the other of the upper portion and the lower portion defining a receiving cavity receiving the head sealably in the connected position;

at least one immobilization member that can be freed from the upper portion relative to the lower portion in the connected position;

a release member for releasing the immobilization member, able to move between an activation position for activating the immobilization member and a release position for releasing the immobilization member;

a mechanism for moving the release member housed in the tool, the movement mechanism comprising an actuator including an energy source, and a receptor for receiving a control signal for powering the actuator via the energy source after receiving the control signal;

wherein the movement mechanism comprises at least one member for elastic stressing of the release member towards a release position and at least one retaining member for keeping the release member in an activation position against the stressing member, the actuator being able to release the retaining member after receiving the control signal, and wherein the upper portion comprises a first electric section, the lower portion comprising a second electric section intended to be connected to an electrical line of the bottom tool, the tool comprising at least one intermediate electrical section connecting the first section to the second section, the intermediate electrical section being disconnectable.

15. A lower assembly intended to be lowered in a well, comprising:

a connector for connecting to a cable working line;

at least one bottom tool; and the intermediate disconnecting tool according to claim 14, wherein at least in the disconnected position of the intermediate disconnecting tool, the connector is connected to the upper portion of the intermediate disconnecting tool, the bottom tool being connected to the lower portion of the intermediate disconnecting tool.

16. A method for disconnecting a lower assembly comprising:

a connector for connecting to a cable working line;

at least one bottom tool; and an intermediate disconnecting tool comprising:

an upper portion, intended to be connected to the cable working line, and a lower portion, intended to be connected to the bottom tool, the upper portion and the lower portion being mounted so as to move relative to each other between a position connected on each other and a completely disconnected position, in which the upper portion can be raised to the surface independently of the lower portion, one of the upper portion and the lower portion defining a head, the other of the upper portion and the lower portion defining a receiving cavity receiving the head sealably in the connected position;

at least one immobilization member that can be freed from the upper portion relative to the lower portion in the connected position;

a member for releasing the immobilization member, mounted able to move between an activation position for activating the immobilization member and a release position for releasing the immobilization member;

a mechanism for moving the release member housed in the tool, the movement mechanism comprising an actuator including an energy source, and a receptor for receiving a control signal capable of for powering the actuator via the energy source after receiving the control signal;

wherein the movement mechanism comprises at least one member for elastic stressing of the release member towards the release position and at least one retaining member for keeping the release member in the activation position against the stressing member, the actuator being able to release the retaining member after receiving the control signal, and wherein at least in the disconnected position, the connector is connected to the upper portion, the bottom tool being connected to the lower portion, and wherein the tool defines at least one pressure equalization orifice connecting the receiving cavity and the outside of the tool, the tool comprising a pressure equalization member able to move in the pressure equalization orifice between a closing configuration closing the pressure equalization orifice and a pressure equalization configuration through the pressure equalization orifice, the method comprising:

receiving a control signal of the actuator from the surface via the receptor activating the actuator via the energy source housed in the tool disengaging the retaining member via the actuator away from the release member;

moving the release member between the activation position of the immobilization member and the release position of the immobilization member under the effect of the stress member and releasing-the immobilization member;

passing the pressure equalization member from the closing configuration towards the pressure equalization configuration upon reaching the release position of the release member;

moving the upper portion via the cable working line, without moving the lower portion to go from the connected position to the completely disconnected position.

17. The method according to claim 16, wherein the pressure equalization member goes from the closing configuration to the pressure equalization configuration under the effect of the pressure from the outside fluid applied on the tool.

* * * * *